US008016689B2

(12) United States Patent
Feys et al.

(10) Patent No.: US 8,016,689 B2
(45) Date of Patent: Sep. 13, 2011

(54) GOLF BALL AIMING DEVICE

(75) Inventors: Robert Feys, Beverly Hills, MI (US); Kent D. Brown, Royal Oak, MI (US)

(73) Assignees: Kent D. Brown, Birmingham, MI (US); Robert Feys, Beverly Hills, MI (US)

( * ) Notice: Subject to any disclaimer, the term of this patent is extended or adjusted under 35 U.S.C. 154(b) by 0 days.

(21) Appl. No.: 12/853,072

(22) Filed: Aug. 9, 2010

(65) Prior Publication Data

US 2010/0304898 A1 Dec. 2, 2010

Related U.S. Application Data

(63) Continuation of application No. 12/391,753, filed on Feb. 24, 2009, now Pat. No. 7,771,284.

(51) Int. Cl.
*A63B 69/36* (2006.01)

(52) U.S. Cl. ..... 473/220; 473/257

(58) Field of Classification Search ..... 473/150, 473/219, 220, 257, 258, 266, 268, 270, 404, 473/407; 101/35, 127

See application file for complete search history.

(56) References Cited

U.S. PATENT DOCUMENTS

| | | | | |
|---|---|---|---|---|
| 5,776,007 | A * | 7/1998 | Kendall et al. | 473/258 |
| 5,904,625 | A * | 5/1999 | Shillingburg | 473/261 |
| 7,048,642 | B2 * | 5/2006 | Burley | 473/270 |
| 7,771,284 | B1 * | 8/2010 | Brown et al. | 473/220 |

* cited by examiner

*Primary Examiner* — Nini Legesse
(74) *Attorney, Agent, or Firm* — Rader Fishman & Grauer PLLC

(57) ABSTRACT

A golf ball aiming device is provided that allows a golfer to accurately position a ball relative to its intended target. The device includes a laser for aiming and pointing the device along with an alignment feature for aligning the ball relative to the device.

20 Claims, 11 Drawing Sheets

GOLF BALL AIMING DEVICE

This application claims priority to U.S. Ser. No. 12/391,753 filed Feb. 24, 2009, which is incorporated herein by reference in its entirety.

TECHNICAL FIELD

This invention relates to a golf ball aiming device and, a method for aiming a golf ball while playing a game of golf.

BACKGROUND AND SUMMARY OF INVENTION

The sport of golfing contains many variables which require a player to develop certain skills in order to improve their game. For example, in the putting portion of the game of golf, stroke, speed, aiming the ball and aiming the putter face are variables which can be controlled by the player. The stroke and speed are dependent in part on the player's ability to gauge the necessary force to be applied to the ball by the putter. There are many physical variables in connection with executing the proper stroke, and speed, which are part of the challenges of the game of golf. These variables are often addressed by practicing the game over and over again.

Likewise, the aiming portion of the putting game also has many variables which further lends to the difficulty of mastering the putting game. Failure to have proper alignment of the ball with the hole on the green leads to many missed putts. It has been shown that most golfers fail to properly align the ball with the hole on the green due to the ball, the face of the putter, and the hole not being properly aligned.

Golfers have attempted to enhance their golf putting game by utilizing various golf aiming devices. Some of these devices can be attached to the golf putter. These devices, however, assist in aligning the face of the putter relative to the ball. Controlling this variable is important, but is not the focus of the present invention. Other devices provide markings on the golf ball which aid the player in the alignment of the ball relative to the target. Other devices have been known to be used to help the golfer with alignment of the ball relative to the flag, or target. They are often cumbersome, difficult to use and somewhat expensive. Moreover, none of these devices work well to help the golfer provide accurate alignment of the ball relative to the target.

It would be desirable to provide a golf ball aiming device that projects an image off in the distance relative to the point where the player would like the ball to be delivered. The aiming device could be positioned over the golf ball and, once the proper spot has been identified where the ball should be delivered, the golf ball can then be aligned relative to, and hence placed in alignment with, the golf ball aiming device. It would be desirable to provide a laser type device securable to a golf aiming device that can be used as a source for providing a light beam at the point which the ball should be delivered to.

It would also be desirable to provide a golf ball aiming device that is portable, lightweight, and perhaps collapsible.

It would be further be desirable to provide a golf ball aiming device that could be utilized for not only putting situations, but also to aid the golfer in driving the ball long distances.

It would also be desirable to provide a golf ball laser device that enhances the player's ability to aim the ball to an intended target thus minimizing, if not eliminating, the variables that are often associated with miss-aiming the ball during putting situations.

DETAILED DESCRIPTION OF THE PREFERRED EMBODIMENTS

Figure 1:
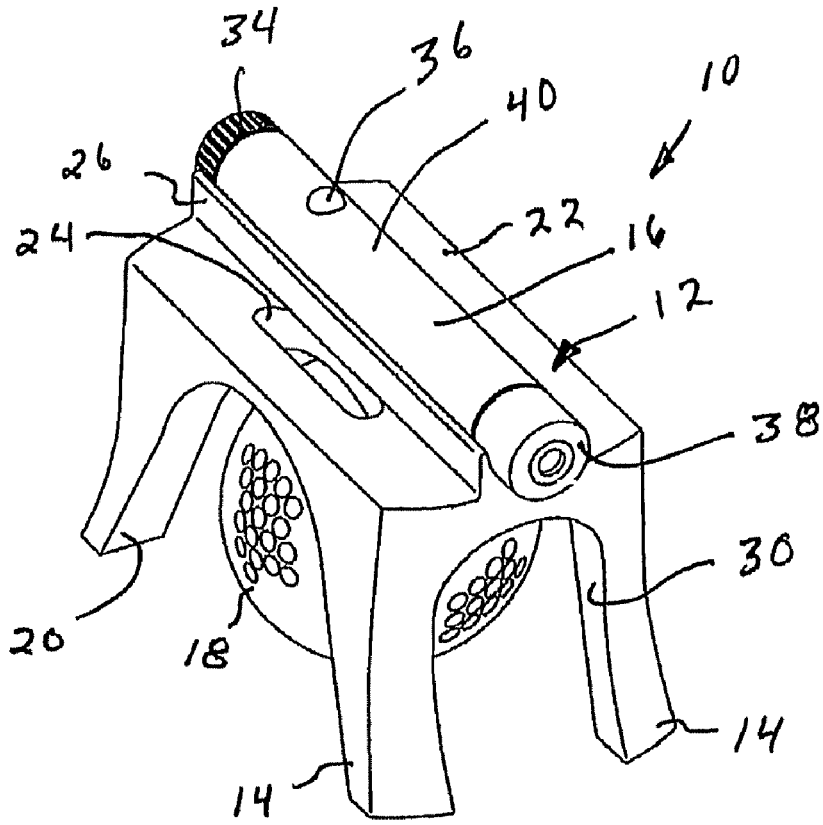
FIG. 1 is a perspective view of a golf ball aiming device.

FIG. 1 illustrates a golf ball aiming device 10 having a base 12, downwardly extending legs 14 and a laser 16. A ball 18 is positioned within an interior cavity 20 of the device 10 and has sufficient clearance to allow a user to easily maneuver the ball 18 within the cavity 20. The base 12 has an upper surface 22, a pair of elongated windows or slots 24 that extend through the upper surface 22, and an upwardly extending retainer wall 26 for positioning the laser 16. The retainer wall 26 runs substantially the axial length of the base 12 and provides a rigid mounting surface for the laser 16 to be located. It will be appreciated that the retainer wall 26 could be on both sides of the laser 16, thus creating a trough for the laser 16 to rest in or to be mounted to. The laser 16 can be secured to the retainer wall 26 through various mechanical fastening conventions, for example, an adhesive.

The slots 24 are located on opposite sides of the laser 16 and provide a window for alignment of the alignment marks that are located on the ball 18. The alignment marks, for example as shown is FIG. 8, can be made utilizing a permanent marker or the like. The slots 24 are substantially longer, then they are wide, so as to allow for a sufficient length of mark to be placed on the ball 18. The slots 24 also act as windows for the player to view through and align the mark relative to the length 28 of the slot 24.

The device 10 has four downwardly and outwardly extending legs 14. The front of the device 10 has an opening 30 that is defined by the spread apart legs 14 and provides a clear line of sight between the ball 18 and the target or hole 32 (see FIG. 29).

The laser 16 has an end cap 34, and on-off button 36 and a laser lens 38. The end cap 34 may be removed from the housing 40 of the laser 16 so as to provide access to a battery compartment. Thus, the device 10 can be serviced by providing a new battery when necessary. This version of the laser 16 is rigidly secured to the base 12 and the laser 16 is in longitudinal alignment with the slots 24. It is preferred that the laser 16 is operable to emit a green light so as to enhance visibility of the light when used outdoors.

Figure 2:
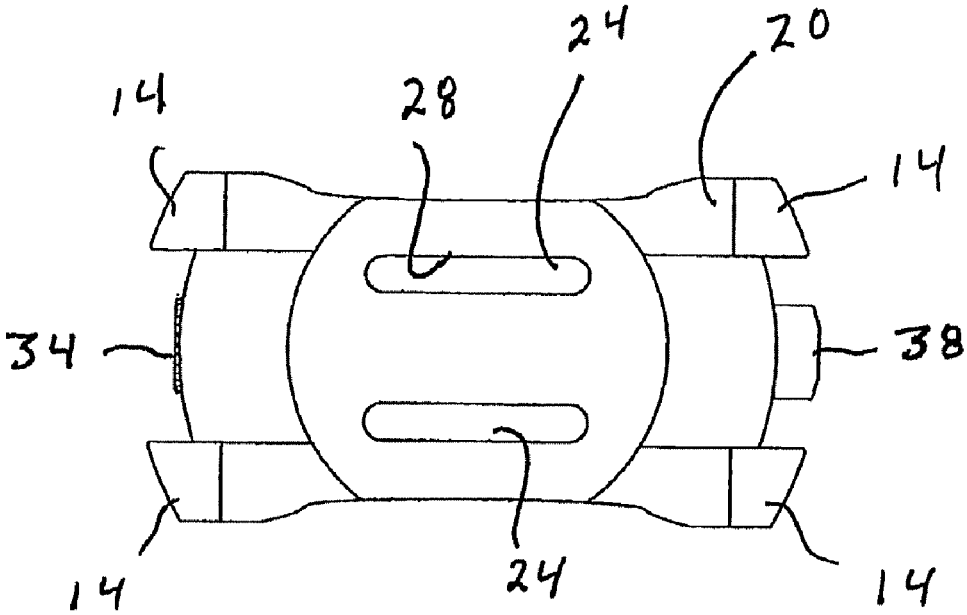
FIG. 2 is a bottom view of the FIG. 1 device.

FIG. 2 illustrates the underside of the FIG. 1 device 10. The legs 14 are spread apart and help define the cavity which provides a large clearance area for the ball. This allows the user to easily locate his fingers in the cavity and manipulate the ball.

Figure 3:
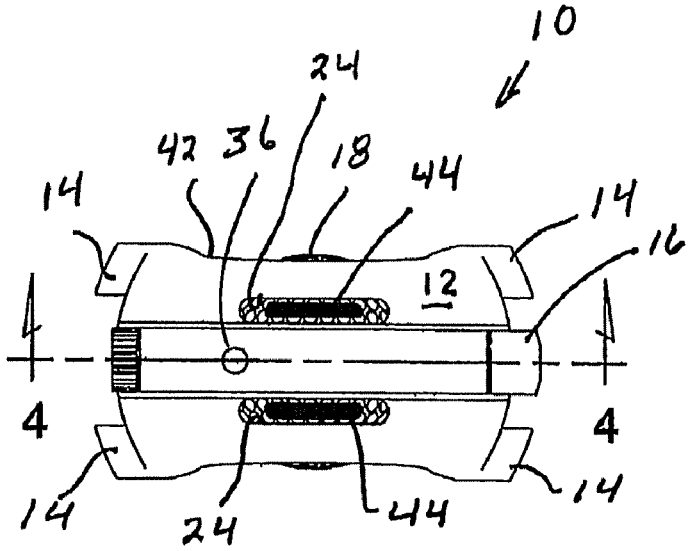
FIG. 3 is a top view of the FIG. 1 device.

FIG. 3 is a top view of the FIG. 1 device 10. The ball 18 is shown extending outside of an indented portion 42 of the base 12. A pair of marks 44 can be viewed through the slots 24. The marks 44 are on the top surface of the ball 18 and are shown in perfect alignment with the slots 24. This view depicts the ball being in perfect alignment with the laser 16. When the player depresses the on-off button 36 a beam of light will be directed towards a target. In this depiction, the ball 18 is in alignment with a target, for example the center line of a hole on a golf green.

Figure 4:
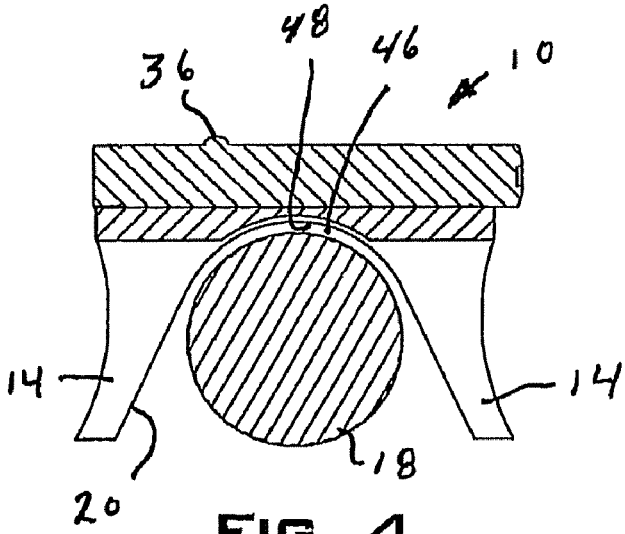
FIG. 4 is a side view of the device taken from the perspective of line 4-4 of FIG. 3.

FIG. 4 illustrates the section taken from line 4-4 of the FIG. 3 device 10. The ball 18 has ample clearance 46 between the top surface of the ball 18 and the underside 48 of the base 12. There should be sufficient clearance 46 between the device 10 and the ball 18 so as to allow the player to easily maneuver the ball 18 within the cavity 20. This provides for ease of alignment of the ball 18, and the marks 44 thereon, relative to the slots 24 and the device 10. Moreover, sufficient clearance is required so as to allow the player easily remove the device 10 once the ball 18 has been properly aligned to the device. The legs 14 therefore are shown in a downwardly and outwardly sloping configuration in the side elevational view so as to enhance the clearance 46.

Figure 5:
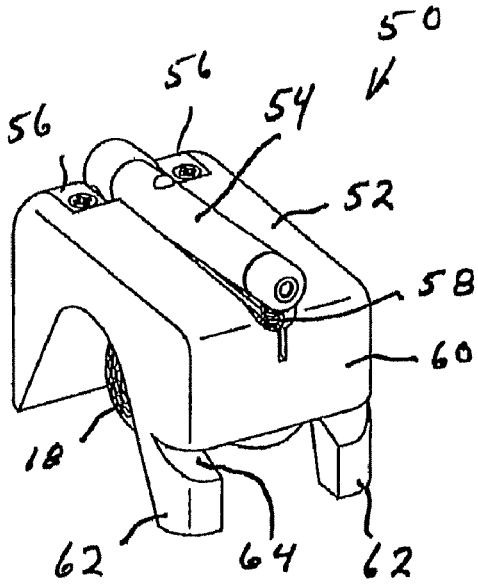
FIG. 5 is a perspective view of an alternative golf ball aiming device.

FIG. 5 illustrates an alternative golf ball aiming device 50 that, like FIG. 1 device, is made of a single piece of construction. It would be appreciated, that the devices 10 and 50 can be made of plastic or other durable material. The device 50 has a base 52, a laser 54, a pair of covers 56 and spring 58.

Figure 6:
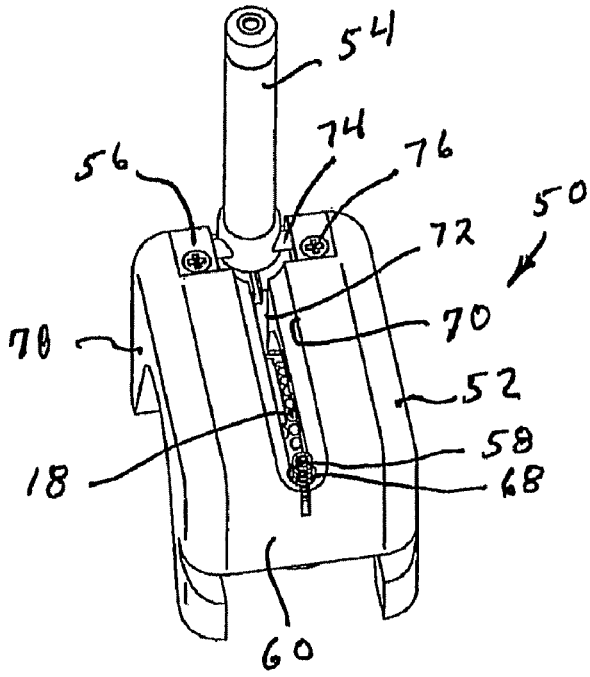
FIG. 6 illustrates the golf ball aiming device with the laser rotated upward and away from the housing.

With reference to FIGS. 5 and 6, the base 52 has a front face 60 with a pair of downwardly extending spaced apart legs 62 and a window 64. The window 64 provides access for a player to utilize a marker 66 to be inserted within the window 64 thus generating a mark 44 on a ball 18. The base 52 also has a vertically extending cavity 68 for receiving the spring 58 which is operable to bias the end of the laser 54.

The base 52 further has a recess 70 that extends a substantial length of the base 52 and includes a window 72 for seeing the ball 18 down below. The window 72 also provides an edge that in turn can be used for providing a straight line on a surface of the ball. Also, a window 72 allows the player to align the mark 44 on the ball 18 relative to the window 72.

The laser 54 has a pair of outwardly extending arms 74 that are held in place by the covers 56 which in turn are held in place by conventional fasteners 76. The laser 54 is pivotally connected to base 52 as a result of the covers 56 compressing the arm 74 against the base 52.

Figure 7:
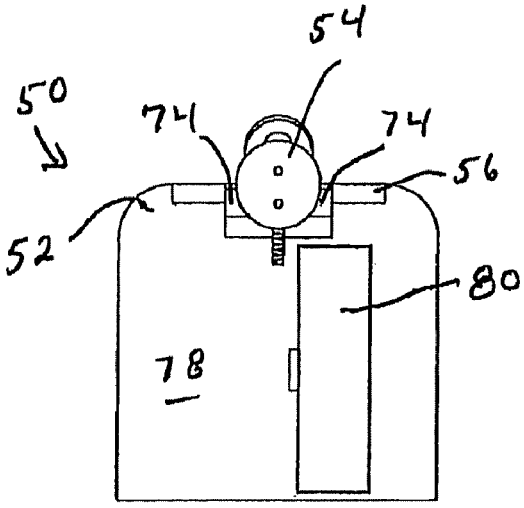
FIG. 7 is a rear view of the FIG. 6 device.

With reference to FIG. 7, the base 52 has a rear face 78 that extends downwardly from an upper surface of the base 52. A door 80 provides access to a battery compartment positioned within the rear face 78. Conventional wiring is utilized to provide the electrical connection between the laser 54 and the batteries located within the battery compartment that lies behind door 80. It will be appreciated that instead of providing interchangeable batteries within a battery compartment within the base 52, a replaceable battery could be housed within the laser 54. Likewise, a battery could be located in other positions within the base 52.

Figure 8:
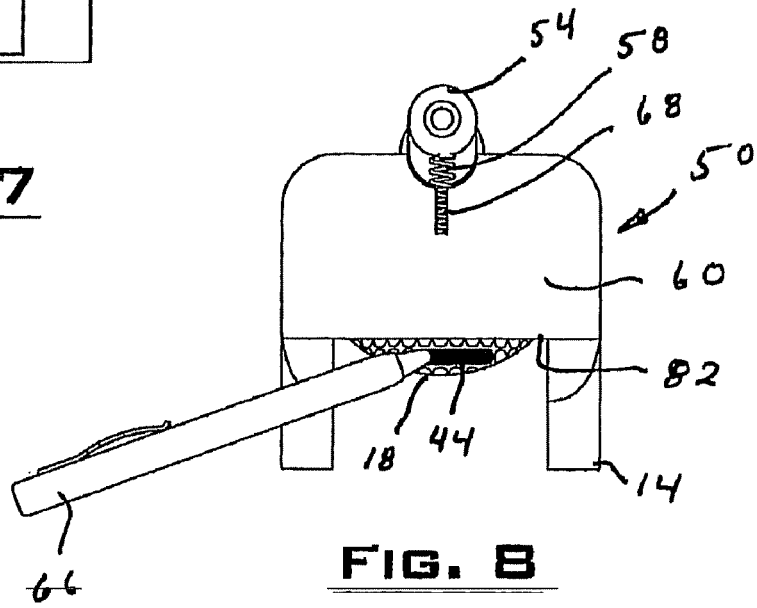
FIG. 8 is a front view of FIG. 6 device, showing a utensil placing a mark on a ball.

With reference to FIG. 8, the ball 18 is shown positioned up within the cavity of the device 50. The player utilizes the marker 66 and manually places a mark 44 on the ball 18 while utilizing edge 82 of window 64 as a guide. Here it is shown with the marker 66 slightly offset from the edge 82 for illustrative purposes only.

Figure 10:
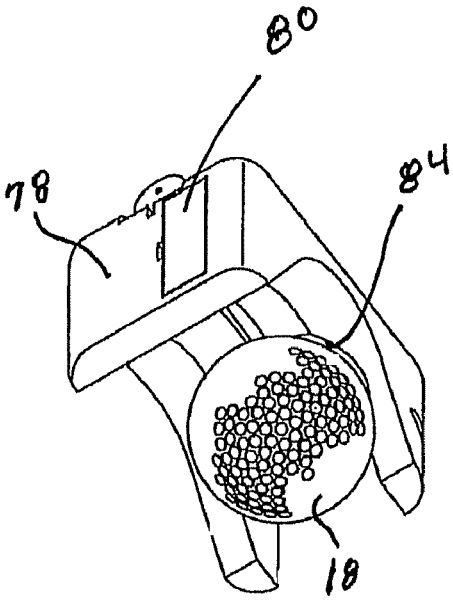
FIG. 10 illustrates the FIG. 6 device, from an underside perspective.
Figure 9:
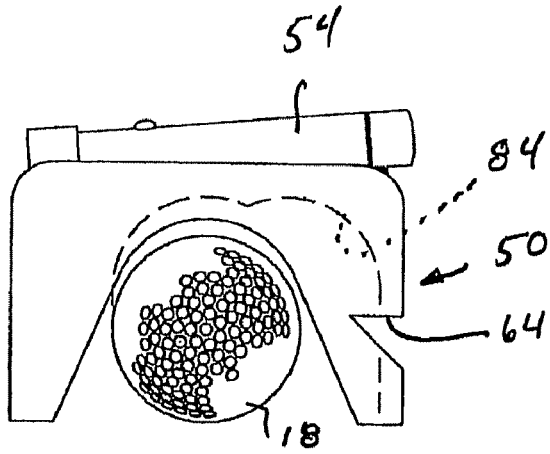
FIG. 9 illustrates a side view of the FIG. 6 device, with the ball located in place.

FIG. 9 illustrates a side view of the FIG. 6 device, with a ball 18 shown relative to the device 50. The device 50 has another interior cavity 84 that is ball-shaped to match the outer configuration of the ball 18. As shown in FIG. 10, the ball 18 is positioned within the cavity 84. This configuration allows the ball to be placed within the cavity 84 and in proper alignment with the window 64. Once the ball is in this marking position, the ball can now have the mark 44 placed thereon so that it is true to the outer surface of the ball 18. For example, see FIGS. 8 and 10 for the proper positioning of the ball 18 during the marking step of this novel process.

Figure 11:
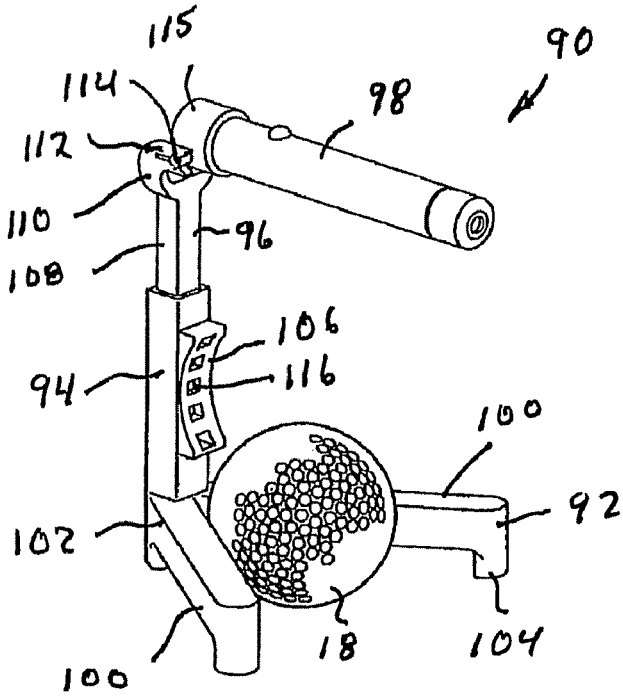
FIG. 11 illustrates a perspective view of an alternative golf ball aiming device.

FIG. 11 illustrates an alternative golf ball aiming device 90 that includes a base 92, a vertically extending middle portion 94, a telescoping portion 96 that is received within the middle portion 94, and a laser 98. The base 92 includes a pair of legs 100 that converge at a central point 102. Each leg has downwardly extending pads 104 which provides stability to the device 90. The legs 100 are sufficiently spread apart to allow a ball 18 to be positioned near the central point 102 and each leg 100 is sufficiently long to provide stability to the device 90.

The middle 94 extends from the central point 102 to an upper end and includes a guide 106 on one of its sides that is concaved shaped for receiving the ball 18. The guide 106 provides a marking surface, or template, for the player to utilize when adding marks 44 to the ball 18. The telescoping portion 96 has an elongated portion 108 and a mounting portion 110. The mounting portion 110 includes an expandable clip portion 112 for receiving a pair of outwardly extending arms 114 on an end cap 115 of the laser 98. The clip portion 112 can be elastic such that it allows the arms 114 to be pivotably snapped to the mounting portion 110. Thus, laser 98 is operable to pivot relative to the telescoping portion 96. The fit there between is sufficiently rigid, such that the laser can maintain its position in a variety of locations once arranged by the player.

The elongated portion 108 is operable to move relative middle portion 94. The elongate portion 108 has detents (not shown) at its lower end thereof that are operable to be received by windows 116 of the guide 106. The elongated portion 108 is adjustable relative to the middle portion 94 so as to change the height of the laser 98. This would allow the device 90 to be utilized, not only for putting, but in situations where the player would like to utilize the device 90 for long drives. Thus, the device 90 can be adjusted vertically, relative to a ball 18 being positioned on a tee (not shown). The laser 98 is not only used for aiding in putting, but can be used for aiming a ball during driving conditions.

Figure 12:
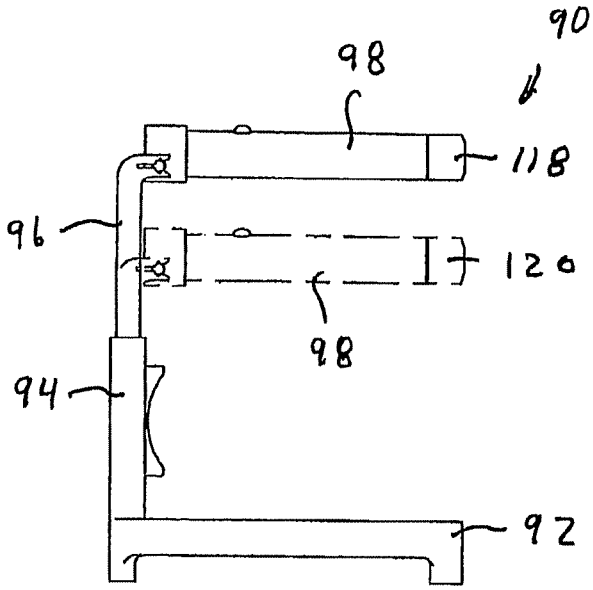
FIG. 12 illustrates a side view of the FIG. 11 device with the laser in different positions.

FIG. 12 illustrates a side elevational view of the FIG. 11 device but with the telescoping portion 96 being shown in two positions. In a first position 118, the laser 98 is shown in an upper position where the telescoping portion 96 is extended to an extreme upper position. By contrast, the laser 98 can be located to second position 120 whereby the laser 98 is shown in a lower position. The device 90 has a lock that allows the vertical position of the laser to be held in place, yet be manually adjustable. The lock is shown in detail in FIG. 15 where the tab 149 and window 142 are in a locking arrangement with one another.

Figure 13:
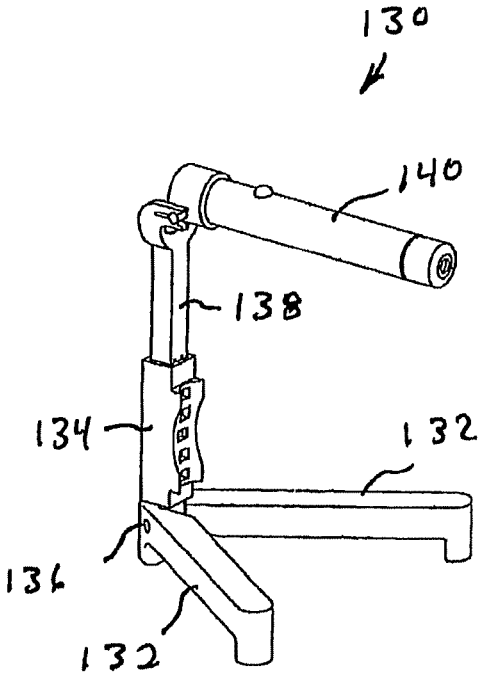
FIG. 13 illustrates an alternative golf ball aiming device, with the lower base portion and the center portion, being pivotally connected thereto.

FIG. 13 illustrates an alternative golf ball aiming device 130 that is collapsible. The device 130 has a pair of legs 132 and a middle portion 134 with a pivot point 136. The pivot point 136 allows the middle portion 134 and the legs 132 to fold relative to one another so as to make the device 130 portable. The device 130 further has the telescoping portion 138 and the laser 140 which are similar to the components that were discussed in the FIG. 11 device.

Figure 14:
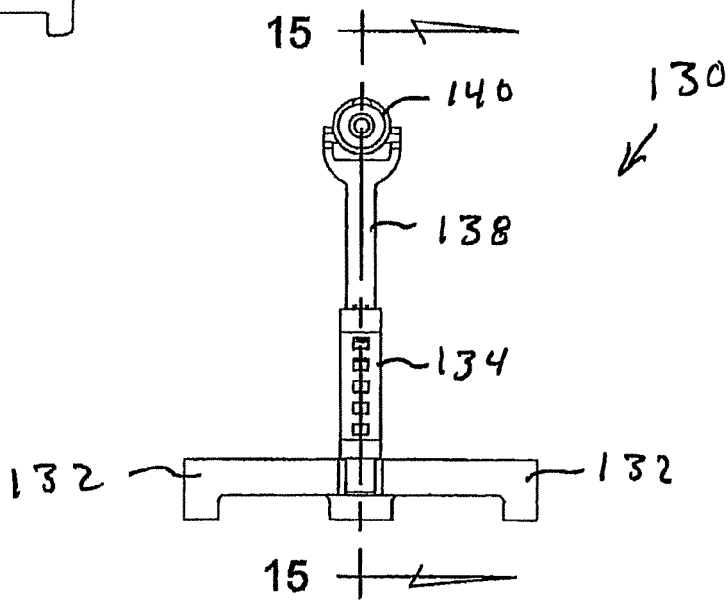
FIG. 14 illustrates a front view of the FIG. 13 device.

FIG. 14 is a front view of the FIG. 13 device 130. The legs 132 are sufficiently spread apart so as to allow the device 132 to be stable while on the putting green or where ever it may be utilized. The width of the device 130 is approximately two thirds of the height of the device 130.

Figure 15:
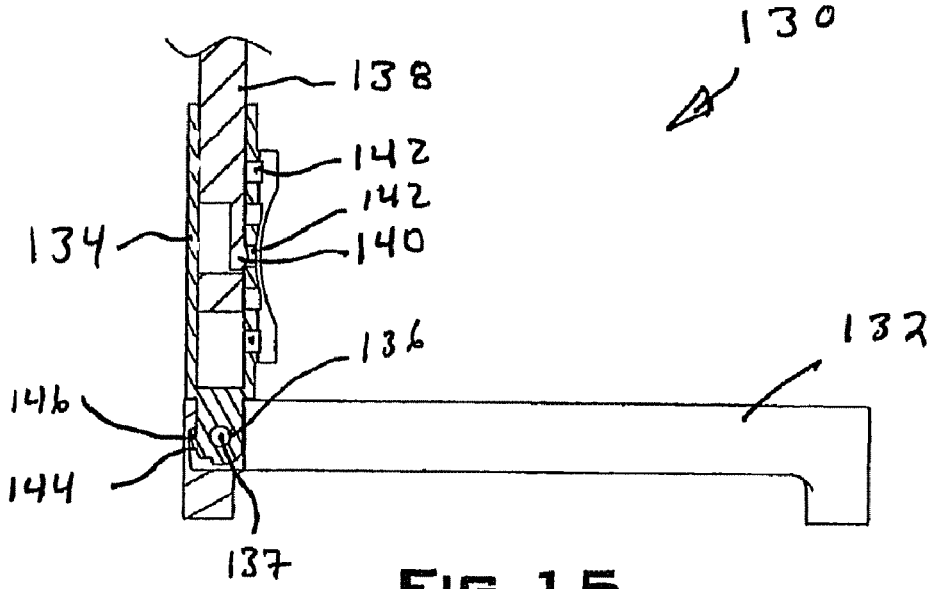
FIG. 15 is a sectional view taken from the lines 15-15, of FIG. 14.

FIG. 15 is a sectional view of the FIG. 13 device, taken from lines 15-15 of FIG. 14. This view shows the telescoping portion 138 having an outwardly extending tab 140 that is operable to be received within one of the windows 142 of the middle portion 134. Once the tab 140 locks in place within one of the windows 142, the height of the device 130 can be secured. These components define a locking member. In order to readjust the height of the device 130, the operator merely needs to depress tab 140, thus providing clearance relative to the windows 142. The pivot point 136 includes a pivot pin 137 that extends through the hole in the legs 132 and pierces a hole within the middle portion 134. The middle portion 134 has a tab 144 that is operable to engage surface 146 of the legs 132. This provides a locking engagement, or second lock, between the legs 132 and the middle portion 134 in order to prevent inadvertent collapsing or folding of the device 130. This second lock enhances the foldability of the device 130.

Figure 16:
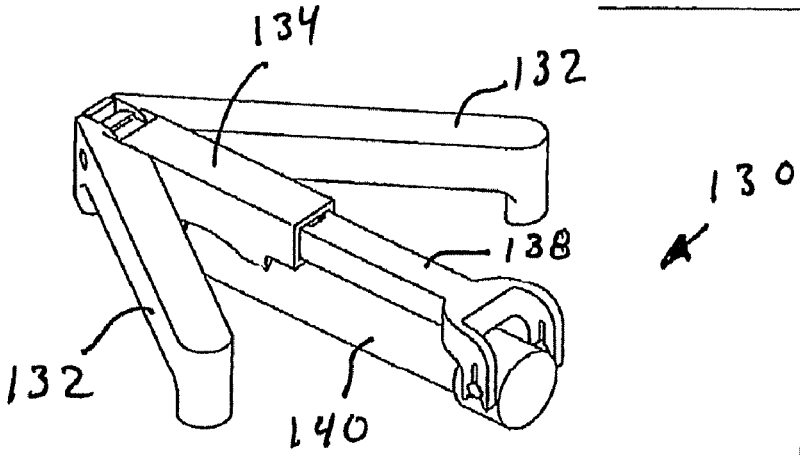
FIG. 16 illustrates the FIG. 13 device in a collapsed condition.

FIG. 16 illustrates the device 130 in a folded or stowed position. The laser 140 is shown folded and laying parallel to the telescoping portion 138 which in turn is shown laying along the same plane as the legs 132.

Figure 17:
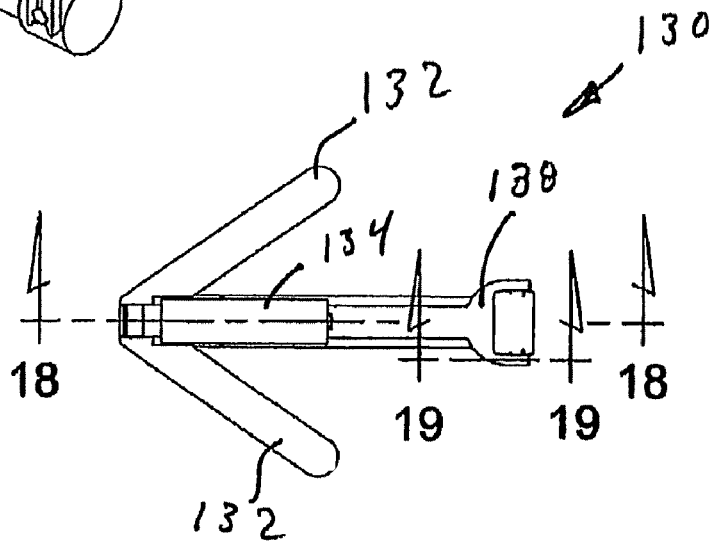
FIG. 17 illustrates the top view of the FIG. 16 device.

FIG. 17 illustrates a top view of the FIG. 16 device while in its folded position. The laser and the middle portion are aligned with one another so as to provide a streamlined configuration.

Figure 18:
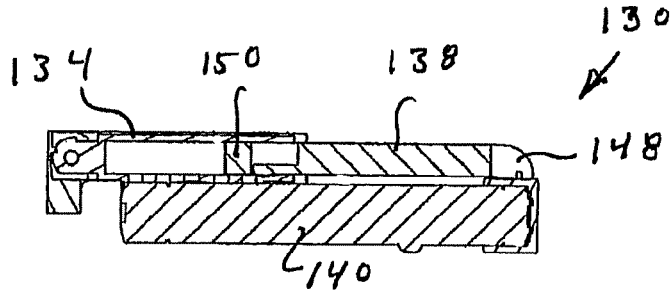
FIG. 18 is a sectional view taken from lines 18-18 of FIG. 17.

FIG. 18 illustrates the FIG. 17 device 130 taken from lines 18-18. The device 130 has a very thin profile which allows the player to place the device 130 in his or her pocket when not in use. The telescoping portion 138 has at its upper end a mounting portion 148 and a lower portion 150 that is operable to telescope within the middle portion 134. The laser 140 is operable to pivot in approximately 180 degrees in direction relative to the mounting portion 148. This provides for a compact arrangement of the device 130 when in its stowed position.

Figure 19:
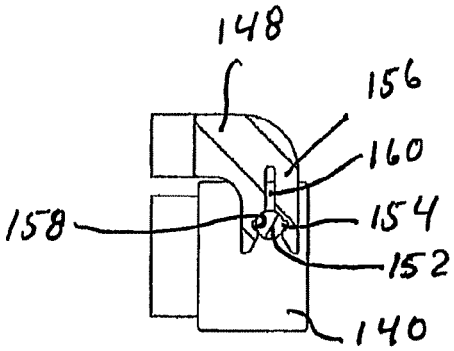
FIG. 19 is a sectional view taken from lines 19-19 of FIG. 17.

FIG. 19 is a sectional view taken from lines 19-19 of FIG. 17, illustrating how the laser 140 and the mounting portion 148 are connected. The laser 140 has an outwardly extending arm 152 with a pair of tabs 154. The mounting portion 148 has a clip portion 156 which includes a pair of detents 158 that are operable to receive the tabs 154 which collectively define a locking means. As shown in FIG. 19, the laser 140 is in the stowed position and is held in place as a result of the interface between the tabs 154 and the detents 158. This represents a stowed, locked position. By contrast, the player can maneuver the laser 140 by approximately 90 degrees thus allowing the tabs 154 to be received within a slot 160 of the mounting portion 148. If the tab 154 is within the slot 160, the laser 140 will be held in place. The clip portion 156 is spring biased in a closed position which aids in maintaining engagement of the tabs 154 relative to the slot 160. Thus, the laser 140 can be maintained in a stowed position, or in an open locked position.

Figure 20:
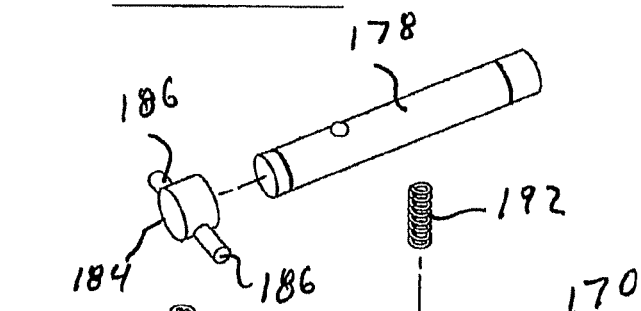
FIG. 20 illustrates an alternative golf ball aiming device having three collapsible legs.
Figure 20:
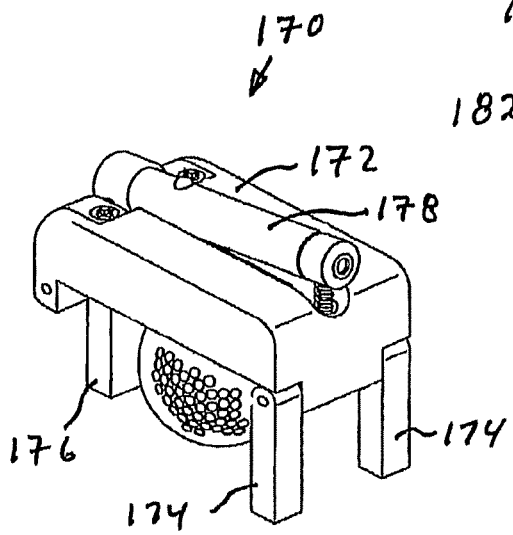
Figure 21:
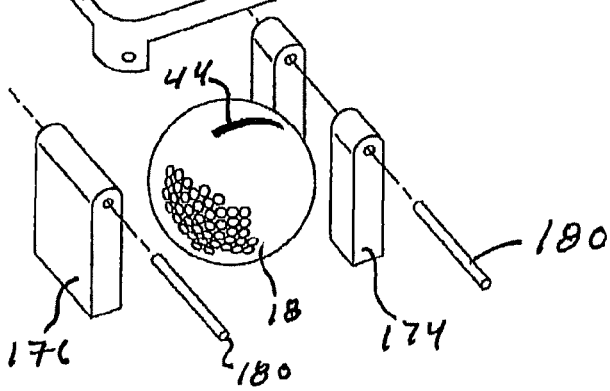
FIG. 21 is an exploded view of the FIG. 20 device.

FIGS. 20 and 21 illustrate an alternative golf ball aligning device 170 that is foldable. The device 170 has a base 172, a pair of folded legs 174, a rear leg 176 and a laser 178. The front legs 174 are pivotally connected to the base 172 as is the rear leg 176. Connector pins 180 pivotally connect each leg to the base 172 via conventional methods. The base 172 has a recess 182 that is operable to receive an end cap 184 and its associated arms 186. Covers 188 secure the arms 186 in place and fasteners 190 secure the covers 188 relative to the base 172. However, the laser 178 is free to pivot relative to the base 172 so as to place the laser in different orientations. A spring 192 is positioned within a slot 194 of the base 172.

Figure 22:
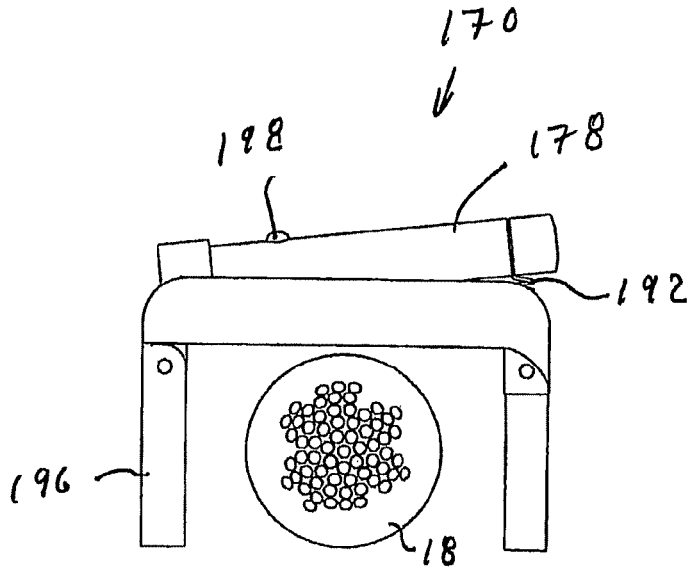
FIG. 22 illustrates a side view of the FIG. 20 device, with a ball positioned relative to the device.

With reference to FIG. 22, the ball 18 is shown within a cavity 196 of the device 170. To operate the device 170, the operator depresses on-off button 198 which applies a downward force on the laser 178 thus allowing the laser to be compressed against the spring and be oriented in a substantially parallel direction to the ground. However, due to the play in the spring 192, the operator will be able to vary the orientation of the resulting laser beam as it is directed towards a target. This provides flexibility for the player to maneuver the laser beam in a vertical direction in the area surrounding the target, yet maintaining lateral positioning of the laser.

Figure 23:
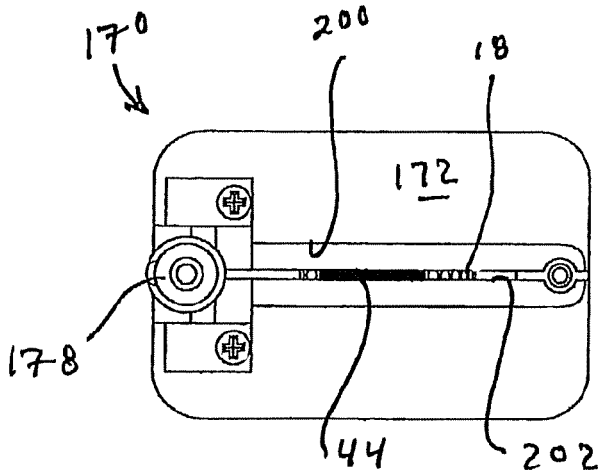
FIG. 23 illustrates a top view of the FIG. 20 device with the laser rotated to a vertical position.

FIG. 23 illustrates the FIG. 22 device but from the top view. Here, the laser 170 has been oriented in a vertical position thus exposing a recess 200 within the top surface of the base 172. Within the recess 200 there is a window 202 that provides a visual access to the ball 18 below. As shown in FIG. 21, the ball 18 has a mark 44 as is shown by a solid line. In the FIG. 23 illustration, the mark 44 is shown in perfect alignment with the window 202. This means the ball 18 is properly aligned with the device 170.

Figure 24:
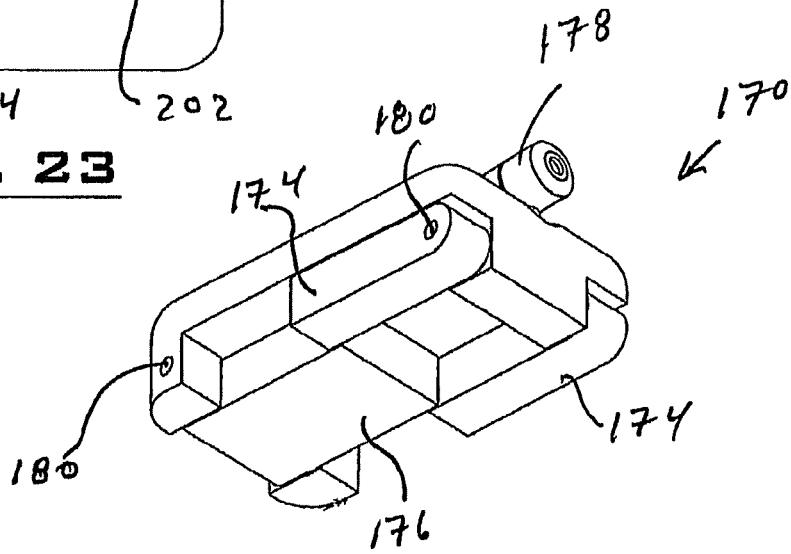
FIG. 24 illustrates the FIG. 20 device in its collapsed condition.
Figure 28:
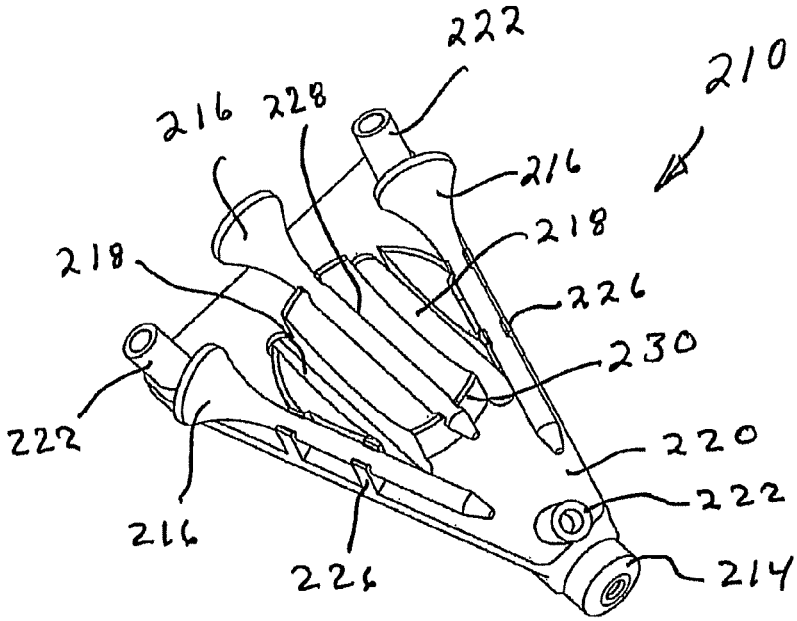
FIG. 28 illustrates the FIG. 25 device from the underside perspective, with its legs shown in a stored condition.

FIG. 24 illustrates the FIG. 28 device in the folded or stowed position. The legs 174 are shown folded, thus giving a streamlined configuration of the device 170. The rear leg 176 is shown nested between the two outer positioned front legs 174.

Figure 25:
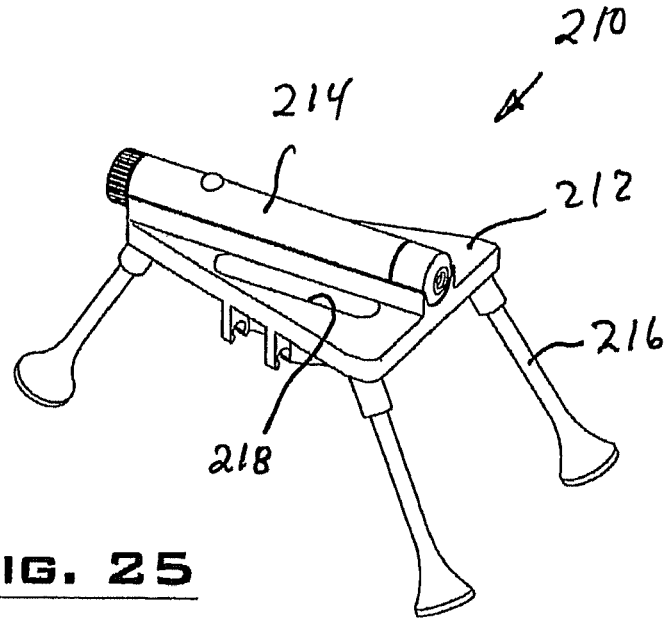
FIG. 25 illustrates an alternative golf ball aiming device.

FIG. 25 illustrates an alternative golf ball aiming device 210 that utilizes golf tees as its legs. The device 210 includes a base 212, a laser 214, and three golf tees 216 depending downwardly from a lower surface of the base. The laser 214 is fixed to the upper surface of the base 212. The base 212 has a pair of slots 218 extending substantially parallel to the longitudinal axis of the laser 214. The slots 218 provide a template for marking parallel lines on ball 18 and a window for the player to visually look through and see the ball below. This becomes important when the player is aligning the ball to the device 210.

Figure 27:
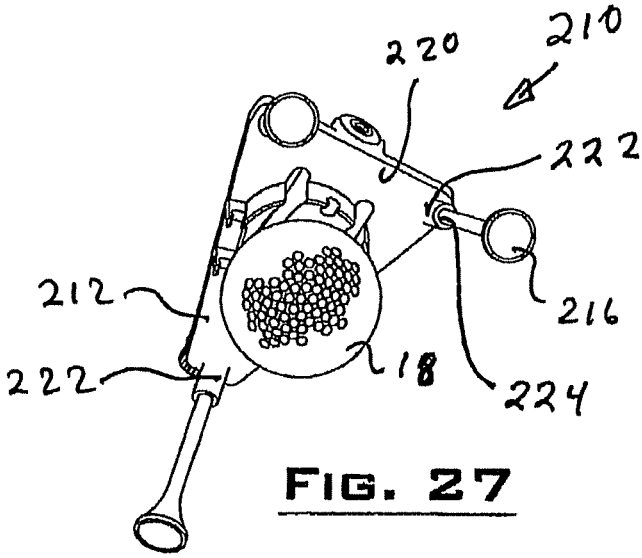
FIG. 27 illustrates an underside perspective view of the FIG. 25 device, with a golf ball shown in a position relative to the housing.

FIG. 27 illustrates an underside perspective view of the device 210. The lower surface 220 of the base includes downwardly extending sockets 222 located at each corner of the triangle-shaped base 212. Each socket 222 includes an internal port 224 for receiving the pointed head of a golf tee 216. Each socket 222 is molded within the base 212. The device is preferably made from plastic.

Figure 26:
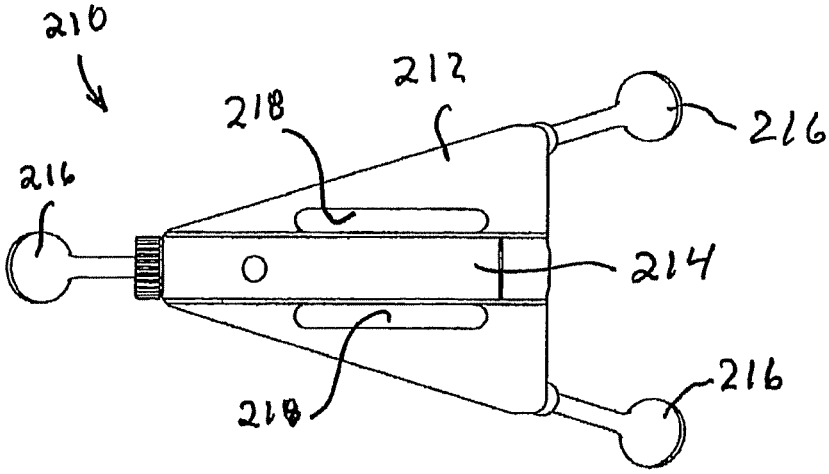
FIG. 26 illustrates a top view of the FIG. 25 device.

Golf tees 216 can be easily removed form the sockets 222 as shown in FIG. 28. FIG. 28 illustrates an underside perspective view of the device 210, but with the golf tees 216 in their stowed position. The lower surface 220 includes a set of clips 226 extending downwardly from the lower surface 220. Each set of clips 226 includes a pair of arms that are operable to spring and lock into place a golf tee 216. The third golf tee 216 is held in place by another clip 228 that is integrally molded within the lower surface 220. The clip 228 is part of a downwardly extending concaved portion 230, which extends from the lower surface 220. The concave portion 230 is shaped similar to the outer periphery of a ball 18. The concave portion 230 operates as a template for receiving a golf ball 18. When the golf ball is placed against this template, it allows a user to insert a marker in slots 218 (see FIG. 26), so as to make one or more markers on the surface of the ball. The purpose of the markers are to allow the ball to be properly aligned relative to the slots 218.

The golf tees 216 can be removed from their stowed position, as shown in FIG. 28, and reassembled to its ready to use state, as shown in FIG. 25. Thus, the device 210 is a portable device that can be easily placed in a stowed condition, or a ready to use condition.

Figure 29:
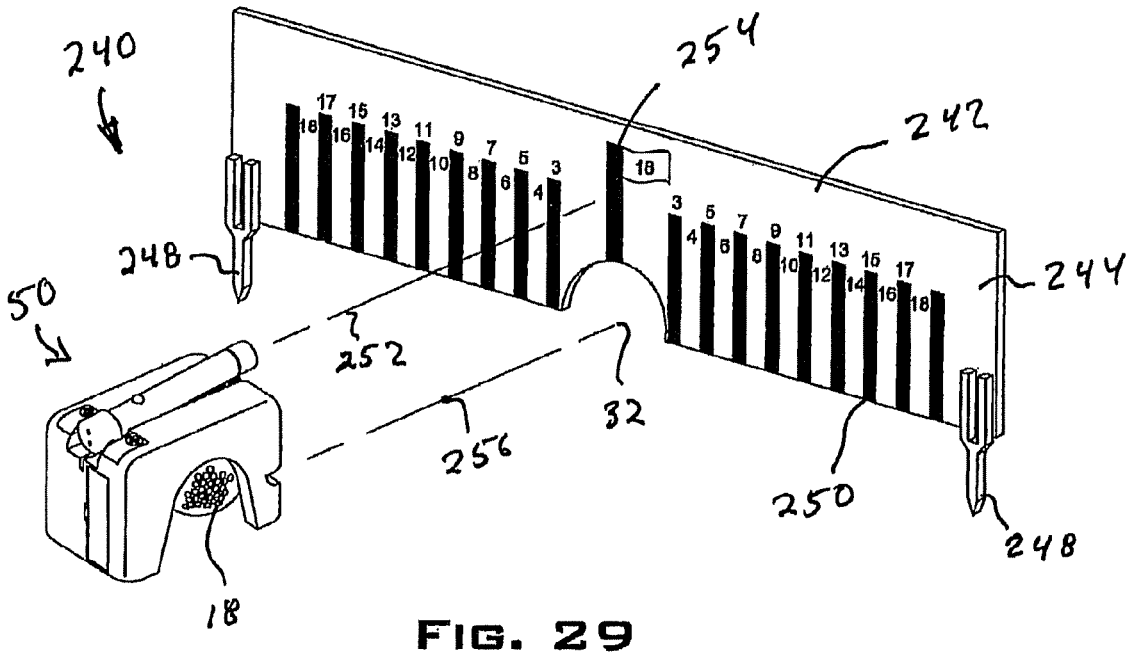
FIG. 29 illustrates a game that can be utilized with the present invention employing a game board.

FIG. 29 illustrates an alternative use of the devices 10, 50, 90, 130, 170 or 210, as disclosed herein. For discussion purposes, reference is made to the device 50. It will be appreciated that any of the aforementioned devices can be utilized with the game system 240 disclosed herein. The game system includes the device 50 and a game board 242. The game board has an elongated board section 244 and a pair of downwardly extending stakes 248. The stakes 248 are secured to the board section 244 which allows same to be planted in the ground. The board section 244 includes a series of markers 250 that are placed along the outside surface of the board section. At the center of the board section 244 there is a hole 32 which is to exemplify the hole on a putting green. Thus, the target would be the center point of the hole 32.

Figure 30:
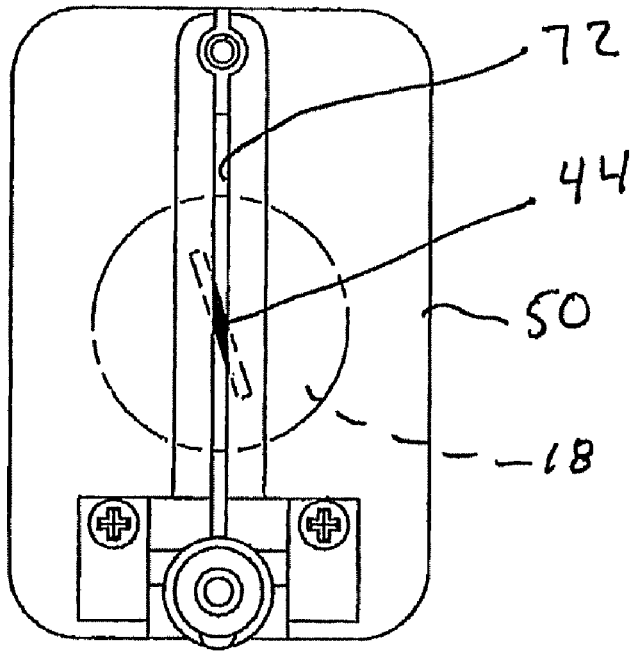
FIG. 30 illustrates the golf ball aiming device, in the top view, with the ball shown in phantom in a misaligned position.

To play the game system 240, the player stakes the game board 242 into the ground. Next, the player places the device 50 over the top of the ball 18 and aligns the laser beam 252 with the target 254. Once the laser is on point with the target 254, the player moves the ball 18 so that it is in proper alignment relative to the device 50. For example, see FIG. 30 where the ball 18 and its corresponding marker 44 are not in alignment with the window 72. Here the ball 18 is shown positioned to the left of its intended target, the hole 32. If a player were to put the ball in this misaligned orientation, the ball would go well to the left of the hole 32. However, utilizing the present novel game system 240, this misalignment will be overcome.

Figure 31:
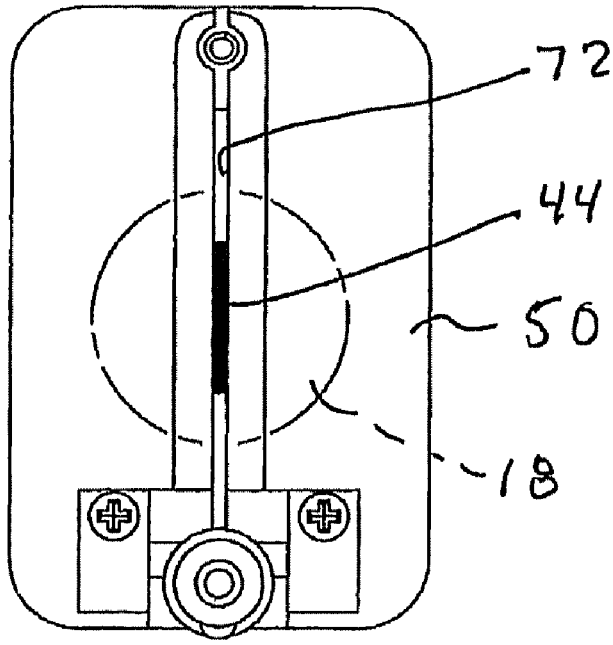
FIG. 31 illustrates the golf ball aiming device, in the top view, with the golf ball shown in phantom in the aligned position.

As shown in FIG. 31, the ball 18 has been orientated to the right thus aligning the marker 44 relative to the longitudinal axis of the window 72. The goal is to make the marker 44 parallel to the window 72. When this occurs, the ball will traverse a straight line 256 and be delivered to the center of the hole 32. Once the ball 18 and the device 50 have been properly aligned relative to one another, the device 50 can be carefully removed thus allowing the ball 18 to be free and clear of any obstructions so that the putt can occur.

In order to operate the novel game system, the following steps can be applied. First, the player will place golf ball 18 into the template on the device 50. While the ball is placed in the template, the player uses a marker to draw one or more lines on the ball. See FIG. 8 for example. Second, the operator places the device 50 directly over the top of the ball 18 with the laser 54 being pointed toward the target. The operator then turns the laser on, and the target can be located. Once the laser has properly located the target, the laser can be turned off. Third, the player then utilizes their fingers to rotate the ball 18 until the marker(s) on the ball 18 are exactly lined up with the window 72. Fourth, the device 50 can then be carefully removed and it is important to not touch the ball during this step. Fifth, utilizing the markers on the ball, the player is now ready to put the ball. The ball is now in a perfect aligned state ready for the player to place the putter behind the ball, with the face square and perpendicular to the marker on the ball. It is now necessary for the player to hit the ball with the proper speed and stroke. The aiming component of the putting game having now been simplified and the accuracy enhanced.

What is claimed is:

1. A golf ball aiming device comprising:

a base having a top surface and a second surface, said top surface having a recess that extends a substantial portion of the top surface;

a plurality of legs extending from a surface of the base; and a laser mounted in the recess in the top surface of the base.

2. The golf ball aiming device as claimed in claim 1, further comprising a window extending through said top surface.

3. The golf ball aiming device as claimed in claim 1, further comprising an on off switch for controlling said laser.

4. The golf ball aiming device as claimed in claim 1, further comprising a battery compartment located in one of said base or legs.

5. The golf ball aiming device as claimed in claim 1, further comprising a cover for securing a portion of said laser to said base.

6. The golf ball aiming device as claimed in claim 1, further comprising an internal cavity that is shaped like the contour of a golf ball.

7. The golf ball aiming device as claimed in claim 1, wherein said legs pivot from a stowed position to a standing position.

8. The golf ball aiming device as claimed in claim 1, wherein said legs can be removed from said base.

9. The golf ball aiming device as claimed in claim 1, wherein said legs can be stowed.

10. A golf ball aiming device comprising:

a plurality of legs extending from a central point;

a telescoping portion extending from said central point; and a laser mounted to said telescoping portion.

11. The golf ball aiming device as claimed in claim 10, wherein said telescoping portion includes a middle portion and a telescoping member that is received with said middle portion, said telescoping member has a connector for receiving said laser.

12. The golf ball aiming device as claimed in claim 10, wherein said laser has outwardly extending arms that are received within a connector of said telescoping portion.

13. The golf ball aiming device as claimed in claim 10, wherein said laser is mounted to said telescoping portion, said laser is operable to move relative to said telescoping portion.

14. The golf ball aiming device as claimed in claim 10, wherein said telescoping portion includes a locking member.

15. The golf ball aiming device as claimed in claim 10, wherein said telescoping portion can be pivoted relative to said legs.

16. The golf ball aiming device as claimed in claim 10, further comprising a game board that is sold in a kit with said device, said game board includes a board section, markers located on the board section, a target point, and a stake for securing said board to a ground.

17. A golf ball aiming device comprising:

a triangle or rectangular shaped base having an upper surface and a lower surface;

a plurality of legs extending from said lower surface of said base; and a laser pivotally mounted to said upper surface of said base.

18. The golf ball aiming device as claimed in claim 17, further comprising a marking window in a surface of said base.

19. The golf ball aiming device as claimed in claim 17, further comprising a leg storage device for housing one or more legs.

20. The golf ball aiming device as claimed in claim 17, further comprising at least one port for receiving a leg.

* * * * *